US006892435B2

(12) United States Patent
Cattaneo

(10) Patent No.: US 6,892,435 B2
(45) Date of Patent: May 17, 2005

(54) MANUFACTURING PROCESS OF A JOINT FOR CONNECTING A LEG TO A TABLE SURFACE

(75) Inventor: Carlo Cattaneo, Figino Serenza (IT)

(73) Assignee: Leonardo S.r.l., Figino-Serenza Como (IT)

( * ) Notice: Subject to any disclaimer, the term of this patent is extended or adjusted under 35 U.S.C. 154(b) by 19 days.

(21) Appl. No.: 10/441,244

(22) Filed: May 19, 2003

(65) Prior Publication Data

US 2004/0074096 A1 Apr. 22, 2004

(30) Foreign Application Priority Data

Nov. 23, 2000 (IT) ..... MI2000A2525
Nov. 20, 2001 (EP) ..... 01204434

(51) Int. Cl.[7] ..... B23P 19/02; B23P 11/00
(52) U.S. Cl. ..... 29/525; 29/525.01
(58) Field of Search ..... 29/897, 417, 428, 29/432, 432.1, 516, 525.01, 525.02, 525.11, 525.14, 525; 248/188, 188.1

(56) References Cited

FOREIGN PATENT DOCUMENTS

| | | |
|---|---|---|
| DE | 12 12 695 | 4/1959 |
| DE | 299 01 409 | 5/1999 |
| EP | 0 307 369 | 3/1989 |
| EP | 0 467 460 | 1/1992 |
| EP | 0 972 466 | 1/2000 |

OTHER PUBLICATIONS

European Search Report.

*Primary Examiner*—John C. Hong
(74) *Attorney, Agent, or Firm*—Hedman & Costigan, P.C.

(57) ABSTRACT

A manufacturing process of a joint (20) for connecting a leg (23) to a table surface or similar element, said joint (20) being of the type comprising: an expandable body, or expander (16) which can be inserted in the complementary hollow top of said leg (23), at least one expansion grub screw (21) which is screwed into a relative threaded nut (22) fitted into a housing (12) of said expander (16), said grub screw (21) being maneuverable from the outside of the leg (23), and anchoring devices (19) joined to the expander (16) for attaching the surface thereto, is characterized in that said expander (16) and said anchoring devices (19) are produced as two separate components which are subsequently firmly joined together, for example by means of welding.

8 Claims, 5 Drawing Sheets

MANUFACTURING PROCESS OF A JOINT FOR CONNECTING A LEG TO A TABLE SURFACE

The present invention relates to a manufacturing process of a joint for firmly connecting a leg to a table surface, or similar supporting element.

The invention also relates to the joint obtained with the above process.

A joint for the stable connection of a leg to a table surface is described and illustrated, for example, in Italian Patent IT-1,028,018 and European Patent EP-0467460, to which reference should be made for further details.

Experts in the field are well aware that, in order to firmly attach a tubular metallic leg to a table surface, it is necessary to have, above all, an intermediate connecting device between leg and surface, capable of ensuring anchorage between the two parts which is both solid and stable over a period of time.

Furthermore, considering current market demands, said connecting device must also have a structure which, in addition to being relatively simple and economic to produce, does not require any complex additional operations, either at the top of the leg or at the surface, at the same time allowing rapid assembly of the table also on the part of non-specialized people, enabling the detached parts to be shipped in packages with minimum bulk and consequently with considerable saving.

The joint, object of patent IT-1,028,018 solves the above problems and consists of a single metallic piece which incorporates a socket (expander) with expandable septa (onto which a tubular metallic leg can be easily fitted), with which a flange or plate is associated, for example circumferential with radial arms or polygonal, for fixing the joint to the table surface by means of screws.

After the tubular leg has been fitted onto the expandable socket, it is firmly attached "in loco" by the expansion of the above septa, said expansion being effected by the tightening of a radial grub screw incorporated in the joint and accessible by means of a hole situated in the leg. In fact, during the tightening phase, the tip of the grub screw acts on the opposite septa of the socket causing their outward radial expansion and consequently adhesion due to friction on the internal surface of the metallic leg.

By unscrewing the grub screw, it is obviously possible to re-separate the joint from the leg as a result of the elasticity of the septa which form the socket or expander.

In this way, a connection system between tubular metallic legs and a table surface is obtained, which does not require any additional operation on the various pieces in assembly phase, and which can be effected without any problems even on the part of non-specialized people.

The joint described above, produced according to the disclosures of patent IT-1,028,018 has given fully satisfactory results.

In the joint of IT-1,028,018, the threaded housing which receives the expansion grub screw of the septa is produced with a separate perforation and threading operations of the socket body, which, on the other hand, is produced in a single piece, together with the flange, by means of die casting.

The perforation and threading operations of the joint socket, after its moulding by means of die casting, obviously requires further manipulation and processing of the item, which significantly influences the end-cost of the article.

In order to eliminate the above perforation and threading operations of the housing of the expansion grub screw of the socket septa, EP-0467460 proposes the production of a joint for firmly connecting a leg to a table surface of the type comprising: an expandable body (expander) which can be inserted into the complementary hollow top of said leg, an expansion grub screw which is screwed into a threaded housing of said body and which can be maneuvered from the outside of the leg, and anchoring devices to the top of the expandable body for attaching the surface thereto, characterized in that the grub screw housing consists of a series of curved sections internally threaded, which are contrapositioned and offset forming openings adjacent to each of the curved sections, in said tubular housing.

The above joints produced according to the disclosures of IT-1,028,018 and EP-0467460 are manufactured in a single piece of metal, generally aluminum, by means of a die casting operation.

The general objective of the present invention is to identify a manufacturing process of said joints, different from moulding in a single piece by means of die casting, which is, on the all, more advantageous than those so far adopted.

This objective is achieved by the process illustrated in the enclosed main claim and minor claims.

The characteristics of the process according to the invention, and of the joint obtained thereby, as also the advantages with respect to the known art, are clearly evident from the following description, referring to the enclosed drawings which illustrate the process phases and the joint obtained therewith. In the drawings:

FIGS. 1–4 schematically illustrate the phases of a process incorporating the disclosures of the present invention for producing the expandable body (expander) which can be inserted in the complementary hollow top of a leg, and to be subsequently welded to a anchorage plate (flange) of the joint to the table surface;

FIG. 6 is a plan view from below, FIG. 7 is a section taken according to the track VII—VII of FIG. 8, and FIG. 8 is a plan view from above;

With reference, firstly, to FIGS. 1–4 of the drawings, these illustrate the phases of a process example for obtaining the expandable socket body, commonly called expander, which, according to the inventive principle, can be produced—separately from the plate—starting from a metallic strip 10 (FIG. 1), for example of simple ferrous material, from which a blank 11 is cut (FIG. 2), having a suitable length for the purpose.

Figure 1:
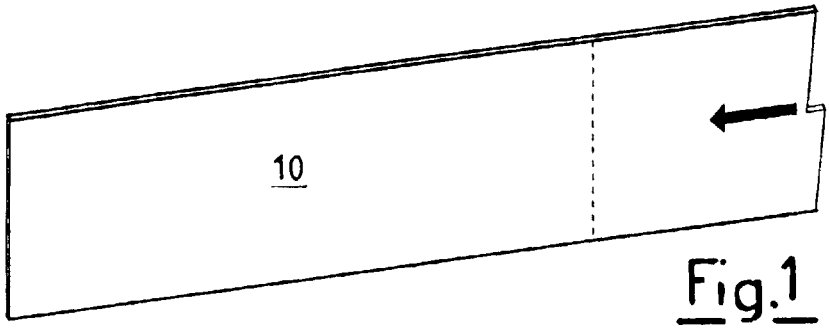
Figure 2:
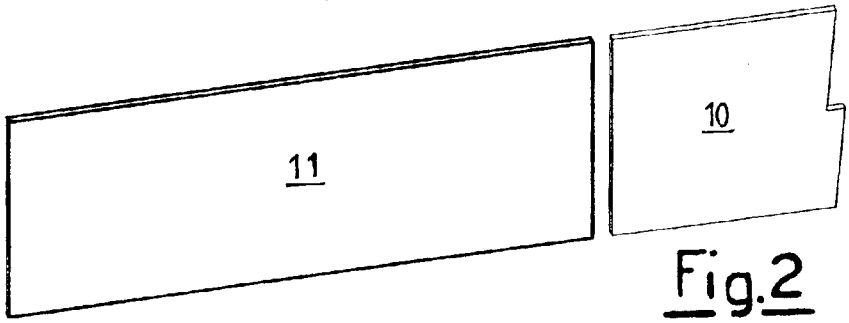
Figure 3:
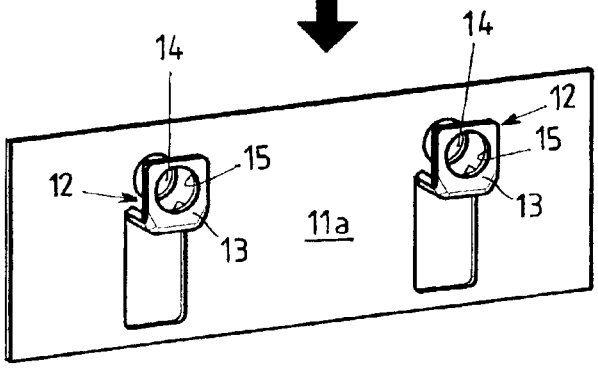

A pair of shaped housings 12, or cradles, formed by means of a blanking and bending operation, are situated at suitable distances in said blank 11, each of which is structurally identified by a shaped square 13 and the blank itself 11 (FIG. 3).

Two coaxial holes 14, 15 are also formed, by means of said blanking and bending operation, in the blank 11 and vertical section of the square 13, respectively, thus obtaining the semi-processed article 11*a* illustrated in FIG. 3 of the drawings.

The above blanking and bending operation can also be effected directly on the strip 10, before being cut into a blank.

Figure 4:
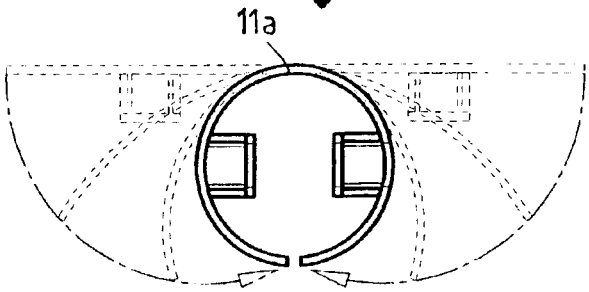
Figure 5:
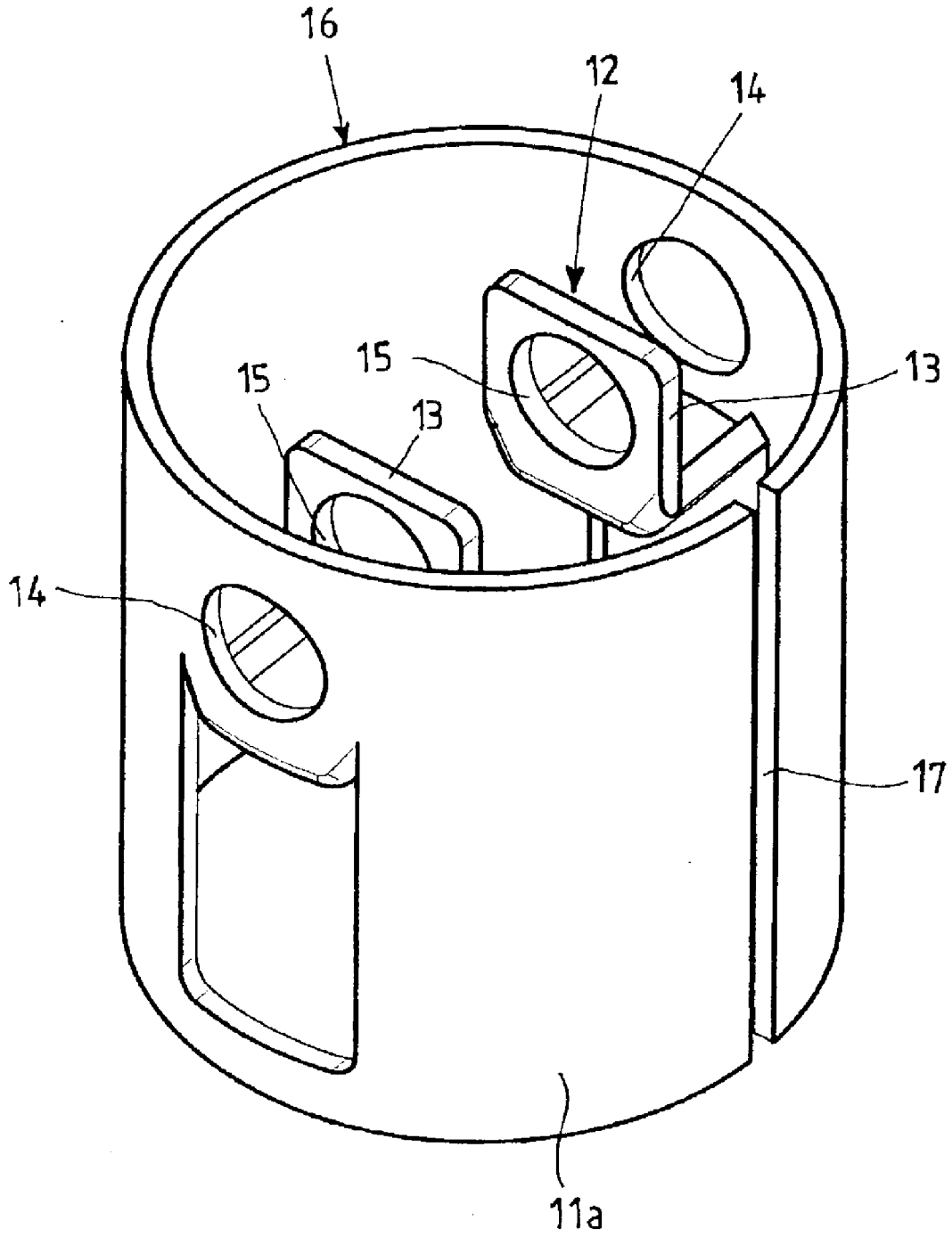
FIG. 5 is an enlarged perspective view illustrating the cylindrical expander obtained by the process phases of FIGS. 1–4.

The semi-processed article 11*a* of FIG. 3 is then shaped (calendered), as shown in the dashed sequence of FIG. 4, until an expandable body 16, or expander, is formed, having for example the socket configuration illustrated in FIG. 5.

It should be pointed out that the expansion possibility of the expander 16 is due to the lack of a stable connection between the opposite edges (generators) of the semi-processed article 11*a* which form a slot 17.

Figure 6:
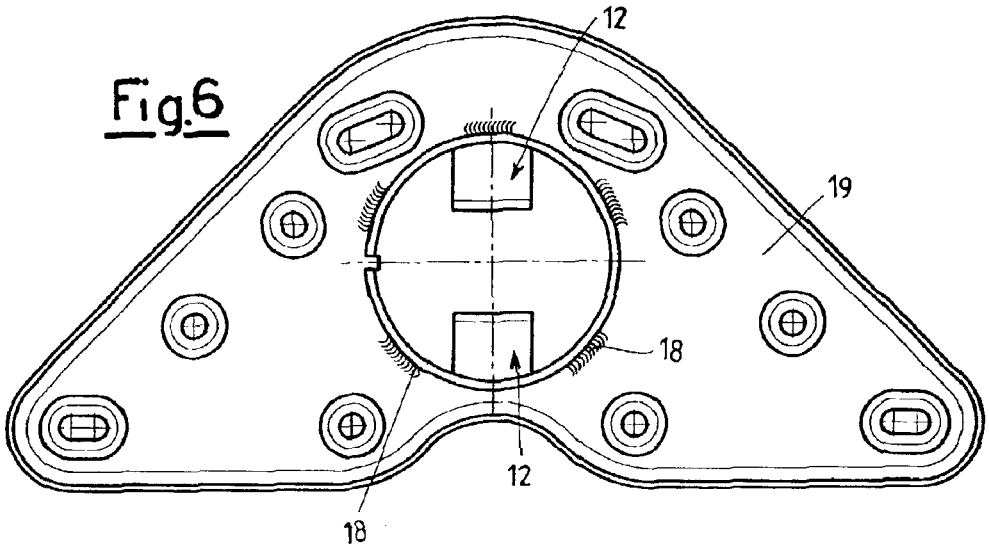
FIGS. 6, 7, 8 illustrate the expander of FIG. 5 welded to an anchorage plate of the joint to a table surface or similar element, where
Figure 7:
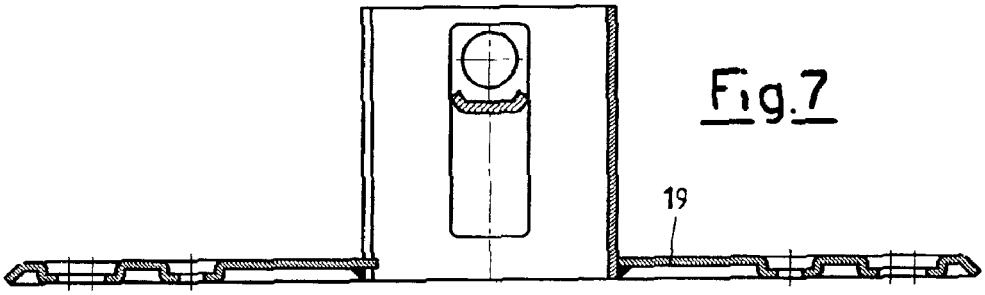
Figure 8:
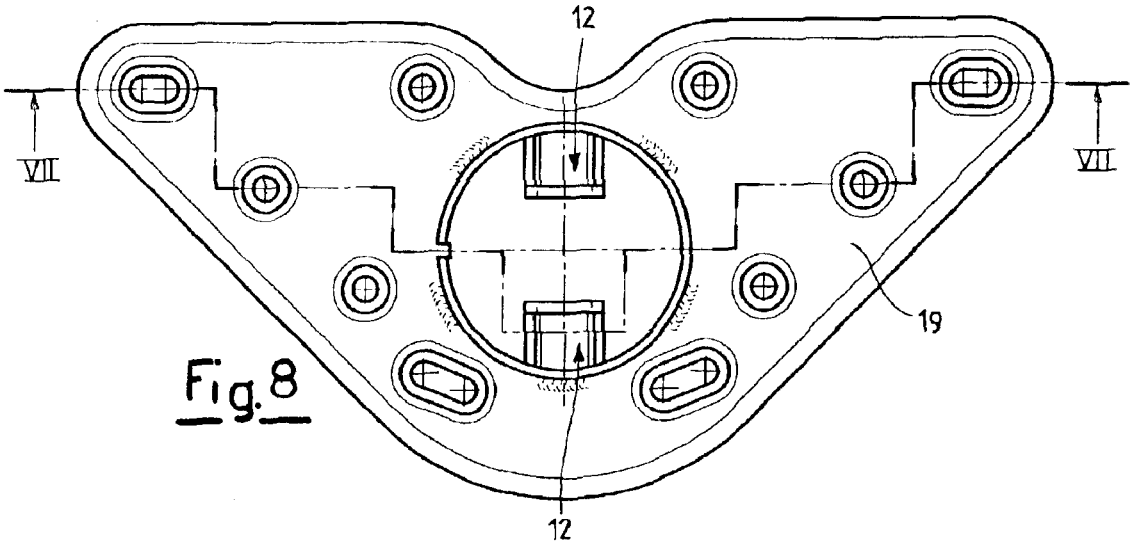

The expander 16 is then welded, with any suitable welding system, for example with the surfacing of material 18 to a plate 19 (which can be of any shape), as illustrated in FIGS. 6–8.

Figure 9:
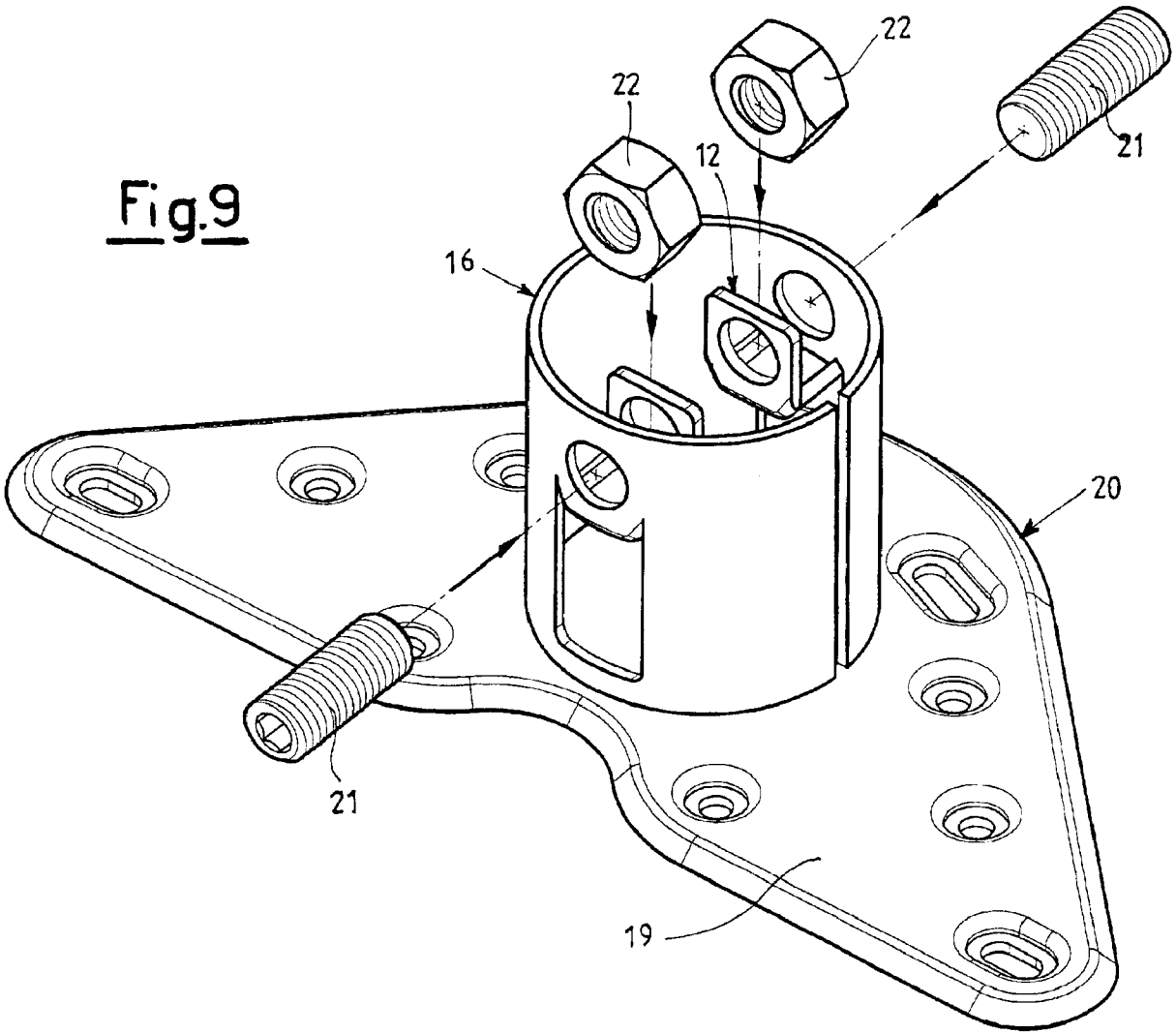
FIG. 9 is a enlarged blown-up perspective view illustrating the insertion phase, in the respective housings of the expander, of the nuts and expansion grub screws.
Figure 11:
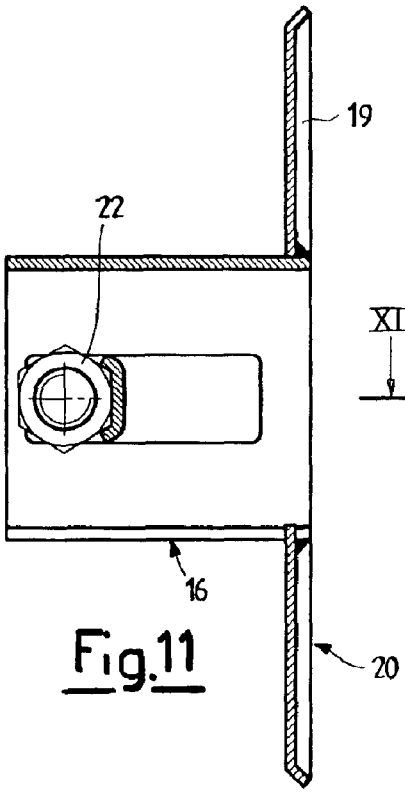
FIGS. 11, 12 are two sections taken according to the tracks XI—XI and XII—XII of FIG. 10, respectively.
Figure 10:
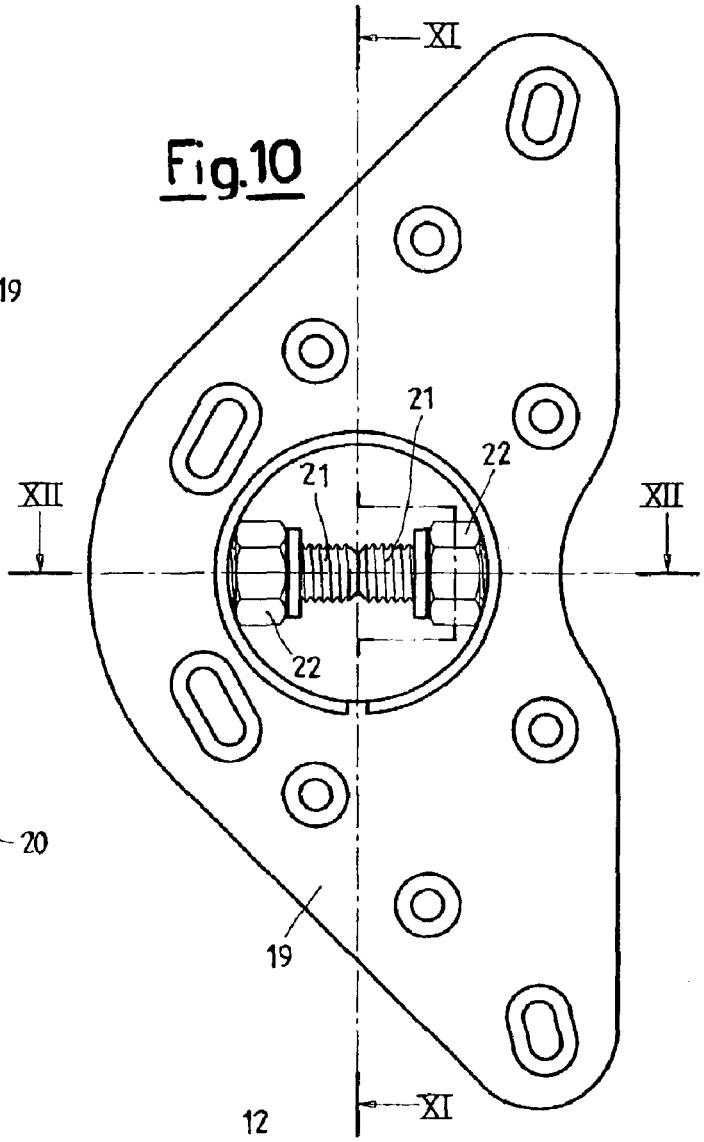
FIG. 10 is a plan view illustrating the joint according to the invention with the pair of grub screws inserted in the respective housings in the expansion position of the socket expander.
Figure 12:
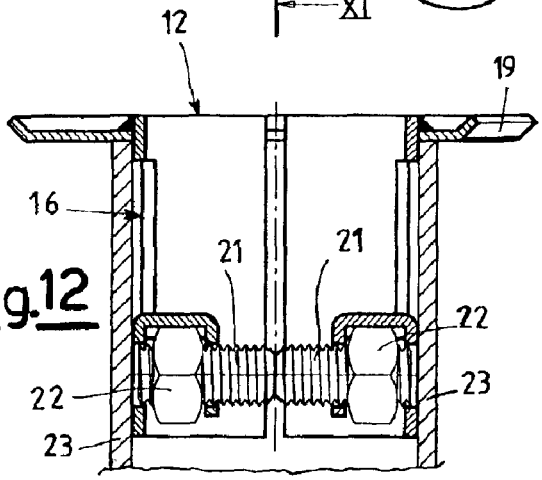

The joint 20 of FIG. 9 is thus obtained, which is completed with the assembly, in the cradles 12, of the respective grub screws 21 and nuts 22 (FIGS. 10–12). The polygonal shape of the cradles 12 prevents the nuts 22 from rotating.

More specifically, after positioning said nuts 22 in the cradles 12, the grub screws 21 are screwed onto the respective nuts 22 passing through the holes 14, 15 as clearly illustrated in FIGS. 9–12 of the drawings. The opposite tips of the grub screws 21 press against each other and consequently the screwing of either of the grub screws 21—alternatively—onto the relative nut 22 causes the expansion of the expander, due to the resulting reaction on the other stationary grub screw 21.

After inserting the top of a tubular leg 23 (FIG. 12) onto the expandable socket body, or expander 16, the latter can therefore be expanded by screwing one of the two grub screws 21 onto the respective nut 22 with the consequent pressure of the free end of said grub screw being screwed onto the stationary grub screw 21; as specified above, this causes the expansion of the expander 16 against the internal surface of the tubular leg 23 and consequently a firm reciprocal anchorage.

As already mentioned, the expander 16 can have varying shapes, and can also be produced, instead of from a strip, starting directly from a tubular body cut along one of its generators.

The basic concept of the present invention is therefore to produce the joint in two separate components (the socket expandable body, or expander 16, and the plate 19), which are then firmly joined by means of welding.

The scope of protection of the invention is therefore defined by the enclosed claims.

What is claimed is:

1. A manufacturing process for a joint (20) for connecting a leg (23) to a table surface, said joint (20) being of the type comprising an expandable body, or expander (16) which can be inserted in the complementary hollow top of said leg (23), at least one expansion grub screw (21) which is screwed into a relative threaded nut (22) fitted into a housing (12) of said expander (16), said grub screw (21) being maneuverable from the outside of the leg (23), and anchoring devices (19) joined to the expander (16) for attaching the surface thereto, is characterized in that said expander (16) and said anchoring devices (19) are produced as two separate components which are subsequently firmly joined together by means of welding wherein said expander (16) is produced from a metallic strip (10).

2. A process according to claim 1, characterized in that said expander (16) is produced starting from a tubular body.

3. A process according to claim 1, characterized in that said anchoring device (19) consist of a polygonal plate.

4. A process according to claim 1, characterized in that it comprises the following phases:

cutting said metallic strip (10) in order to obtain a blank (11);

forming a housing (12) for said grub screw (21) and nut (22) from said blank (11) by means of blanking and bending, in order to obtain a semi-processed article (11*a*);

shaping (calendering) said semi-processed article (11*a*) into said expander (16); and attaching the expander (16) thus obtained to said anchoring devices (19).

5. A process according to claim 1, characterized in that it comprises the following phases:

forming a housing (12) for said grub screw (21) and nut (22) from said metallic strip (10) by means of blanking and bending;

cutting said metallic strip (10) in order to obtain a semi-processed article (11*a*);

shaping (calendering) said semi-processed article (11*a*) into the configuration of said expander (16); and attaching the expander (16) thus obtained to said anchoring devices (19).

6. A process according to claim 1, characterized in that said joint (20) comprises a pair of opposing grub screws (21) with relative threaded nuts (22), each pair fitted into a respective housing (12).

7. A process according to claim 1, characterized in that said housing (12) generally has a cradle-shaped configuration.

8. A process according to claim 7, characterized in that said cradle housing (12) is structurally formed by a shaped square (13) and by the metallic strip itself, two coaxial holes (14, 15) being situated in said metallic strip and in the vertical section of the square (13), for the passage of the grub screws (21).

* * * * *